US008903542B2

(12) United States Patent
Tresse et al.

(10) Patent No.: US 8,903,542 B2
(45) Date of Patent: Dec. 2, 2014

(54) METHOD OF PROCESSING MAILPIECES, THE METHOD INCLUDING COMBINING THE BATCHES OF MAILPIECES

(71) Applicant: Solystic, Gentilly Cedex (FR)

(72) Inventors: Didier Tresse, Saint Laurent d'Onay (FR); Christophe Lhomme, Paris (FR)

(73) Assignee: Solystic, Gentilly Cedex (FR)

( * ) Notice: Subject to any disclaimer, the term of this patent is extended or adjusted under 35 U.S.C. 154(b) by 78 days.

(21) Appl. No.: 13/712,696

(22) Filed: Dec. 12, 2012

(65) Prior Publication Data

US 2013/0173050 A1 Jul. 4, 2013

(30) Foreign Application Priority Data

Dec. 19, 2011 (FR) ..... 11 61929

(51) Int. Cl.
*G06F 7/00* (2006.01)
*B07C 99/00* (2009.01)
*B07C 3/00* (2006.01)

(52) U.S. Cl.
CPC .... *B07C 9/00* (2013.01); *B07C 3/00* (2013.01)
USPC ..... 700/223; 700/213; 700/214; 700/219; 700/221; 700/224; 700/225; 700/226

(58) Field of Classification Search
None
See application file for complete search history.

(56) References Cited

U.S. PATENT DOCUMENTS 5,346,072 A * 9/1994 Dian et al. ..... 209/584
5,420,403 A * 5/1995 Allum et al. ..... 235/375
6,703,574 B1 * 3/2004 Kechel et al. ..... 209/584

FOREIGN PATENT DOCUMENTS

EP 1872869 1/2008
EP 2091012 8/2009

OTHER PUBLICATIONS

Australian Patent Examination Report; Australian Patent Application No. 2012261487; Issued Mar. 8, 2013.
European Search Report; Application No. EP 12 19 2507.7; Mailed Apr. 2, 2013.
French Search Report dated Jul. 17, 2012, filed in French counterpart Application No. 1161929, 5 pages.

* cited by examiner

*Primary Examiner* — Yolanda Cumbess
(74) *Attorney, Agent, or Firm* — Patterson & Sheridan LLP

(57) ABSTRACT

A method of processing mailpieces for sorting mailpieces into sequence in a sorting machine depending on delivery points of delivery rounds, in which method the mailpieces are grouped together into batches associated with delivery rounds and are sorted as a function of various sorting plans each associated with a respective batch of mailpieces and defining a list of delivery points of delivery rounds, which method includes the following steps, assessing the batches of mailpieces before the machine sorting to detect those that will under-use the sorting capacities; aggregating the batches of mailpieces detected as under-using the capacity so as to constitute aggregated batches of mailpieces; computing an associated sorting plan resulting from the aggregating; feeding each aggregated batch of mailpieces into the postal sorting machine and controlling the sorting of the mailpieces as a function of the sorting plan computed for said aggregated batch of mailpieces.

4 Claims, 3 Drawing Sheets

METHOD OF PROCESSING MAILPIECES, THE METHOD INCLUDING COMBINING THE BATCHES OF MAILPIECES

CROSS-REFERENCE TO RELATED APPLICATIONS

This application claims benefit of French Patent Application No. 1161929, filed Dec. 19, 2011, which is herein incorporated by reference.

BACKGROUND OF THE INVENTION

1. Field of the Invention

The field of the invention is the field of automatically processing mailpieces, it being possible for said mailpieces to be letters, "flats" (i.e. large-format flat articles, e.g. magazines or newspapers wrapped in plastic or in paper), or indeed parcels.

More particularly, the invention relates to a method of processing mailpieces for sorting mailpieces into sequence in a postal sorting machine depending on delivery points of delivery rounds, in which method the mailpieces are grouped together into various batches associated with one or more delivery rounds and are sorted in the postal sorting machine by batch as a function of various sorting plans associated respectively with the various batches of mailpieces, each sorting plan associated with a batch of mailpieces defining an ordered list of delivery points of one or more delivery rounds, with delivery points being put into correspondence with sorting outlets of the postal sorting machine.

2. Description of the Related Art

Patent Document EP 2 091 012 discloses a method of processing mailpieces for sorting mailpieces into sequence in a postal sorting machine depending on delivery points of delivery rounds, in which method the mailpieces are grouped together into various batches associated with one or more delivery rounds and are sorted in the machine by batch as a function of various sorting plans associated respectively with the various batches of mailpieces, each sorting plan associated with a batch of mailpieces defining an ordered list of delivery points of one or more delivery rounds. Once the quantity of mailpieces in each group is known, articles that have similar identifiers are allocated the same sorting outlet.

Patent Document EP 1 872 869 discloses a method that consists in obtaining information about the volume of the postal articles to be sorted into a plurality of groups of mail. Each group of mail comprises a plurality of postal articles, each of which has a delivery identifier. A sorting bin is allocated for each group of mail. The identifier on each postal article is detected and the postal article is then conveyed in response to said detection to an allocated mail sorting bin corresponding to the delivery identifier.

Patent Document U.S. Pat. No. 6,703,574 discloses a method of sorting mailpieces into sequence depending on delivery points of delivery rounds. In that method, simulations are performed before machine-sorting the mailpieces so as to assess the occupancy of the sorting outlets of the machine and so as to reorganize the corresponding sorting plan in order to prevent the sorting outlets from overflowing.

Currently, sorting machines are controlled using pre-established sorting plans that are configured by taking into account the number of sorting outlets of the machine, the number of delivery points for each delivery round to be sequenced, the number of sorting passes to be performed for sequencing the mailpieces for delivery by a person, and where applicable the storage capacity of the sorting outlets of the machine. For example, some sorting machines in inward sorting centers have twenty sorting outlets (one of which is reserved for rejects), and so they have a sorting capacity of about six thousand eight hundred delivery points, which is equivalent to five delivery rounds each including, on average, one thousand three hundred delivery points.

Sorting plans that are static do not take into account the dynamic characteristics of the flows of mail to be sorted. Such sorting plans are configured to be balanced, i.e. to use all of the sorting resources of the machine if it is considered that the flows of mail to be sorted are always distributed uniformly over the delivery points of the delivery rounds.

However, on arriving at an inward sorting center (arrival sorting center) where the mailpieces are sorted for delivery by the delivery person, the flow of mail is never of constant volume and is never distributed uniformly over the delivery points, which can, as indicated above, give rise to sorting outlets overflowing, and also to non-optimum use of the sorting machine. Thus, for some batches of mailpieces to be sorted on any one day, certain sorting outlets of the machine can remain empty due to absence of mail for certain series of delivery points. That situation ultimately leads to lowering of the throughput rate of the machine due to a low volume of mail to be sorted, thereby increasing the mail processing costs accordingly.

SUMMARY OF THE INVENTION

An object of the invention is to propose a method of processing mailpieces as indicated above that remedies those drawbacks.

The basic idea of the invention is to assess the occupancy of the postal sorting machine by considering the flow of mail to be passed through the machine, and in particular the batches of mailpieces to be successively machine-sorted, and then, dynamically, to reorganize said batches of mail and the associated sorting plans if the result of the assessment corresponds to it being detected that the sorting capacities of the postal sorting machine are under-used. The invention is based on the fact that the flow of mail for a certain inward sorting center is known in advance, e.g. because it is retrieved at the outlet of another postal sorting machine of an outward sorting center (departure sorting center), or indeed because it is produced by a bulk mail sender who has already established an electronic statement of mailpieces in the form of a list of mailpiece identifiers in correspondence with sort codes. On the basis of this information, it is possible to determine, in each batch of mailpieces making up said flow of mail, the delivery round delivery points for which there is no mail to be delivered (empty or non-active delivery points), and then, on this basis, to optimize the filling of the sorting outlets of the postal sorting machine by reorganizing the batches of mailpieces and the associated sorting plans.

More particularly, the invention provides a method of processing mailpieces for sorting mailpieces into sequence in a postal sorting machine depending on delivery points of delivery rounds, in which method the mailpieces are grouped together into various batches associated with one or more delivery rounds and are sorted in the postal sorting machine by batch as a function of various sorting plans associated respectively with the various batches of mailpieces, each sorting plan associated with a batch of mailpieces defining an ordered list of delivery points of one or more delivery rounds, which method is characterized by the following steps:

assessing the mailpieces before the machine sorting to detect those that will under-use the sorting capacities of the postal sorting machine, i.e. those for which the mailpieces will fill the sorting outlets of the postal sorting machine to an insufficient extent;

aggregating the batches of mailpieces detected as under-using the machine capacity so as to constitute one or more aggregated batches of mailpieces;

computing in the postal sorting machine, for each aggregated batch of mailpieces, an associated sorting plan resulting from the aggregating; and feeding each aggregated batch of mailpieces into the postal sorting machine and controlling the machine in such manner as to sort the mailpieces as a function of the sorting plan computed for said aggregated batch of mailpieces.

The method of the invention may have the following features:

on the basis of the delivery addresses recognized on the mailpieces of a batch of mailpieces, the assessment consists in counting, in said batch of mailpieces, the delivery points that correspond to said delivery addresses and in comparing the count value with a threshold so as to determine whether the batch of mailpieces in question will under-use the sorting capacities of the postal sorting machine;

the aggregating of the batches of mailpieces consists in concatenating batches of mailpieces;

the aggregating of the batches of mailpieces consists in redistributing the delivery rounds associated with the batches of mailpieces; and the aggregating of the batches of mailpieces consists in geographically reassigning the delivery points in the delivery rounds associated with the batches of mailpieces.

BRIEF DESCRIPTION OF THE DRAWINGS

The invention can be understood more clearly on reading the description of an implementation of the method of processing mailpieces that is shown in the drawings, in which.

DETAILED DESCRIPTION

The invention aims to optimize use of the sorting capacities of a postal sorting machine in an inward sorting center where the mailpieces are sorted into sequence depending on the delivery points of delivery rounds or "postman's walks".

In order to illustrate implementing the method of the invention, it is considered that mail is processed in an outward sorting (departure sorting) center of a postal operator (e.g. a postal authority) in a first postal sorting machine during a first sorting pass. The postal address of each mailpiece is recognized by Optical Character Recognition (OCR) or by on-line or off-line video-coding, a unique identifier is associated with each mailpiece and a sort code or delivery point in a delivery round is determined on the basis of the recognized postal address and is associated with the mailpiece identifier.

This data is stored in a database of a computer control unit or central server of the postal operator. The purpose of this first sorting pass in the outward sorting center is to separate the mailpieces between various inward sorting centers of the postal operator. Each inward sorting center may serve a plurality of delivery offices from which mail is delivered by mail delivery staff to the mailboxes of the recipients.

The central server is in charge of collecting all of the mailpiece identifiers and the results of postal address recognition from some or, for example, all of the outward sorting centers of the postal operator at national level. The central server keeps this data in a database for retrieval by the machines of the inward sorting centers and where applicable by the machines of the delivery offices so as to continue the sorting process in a plurality of sorting passes until the mailpieces are in ordered sequence for being delivered by the mail delivery staff.

Figure 1:
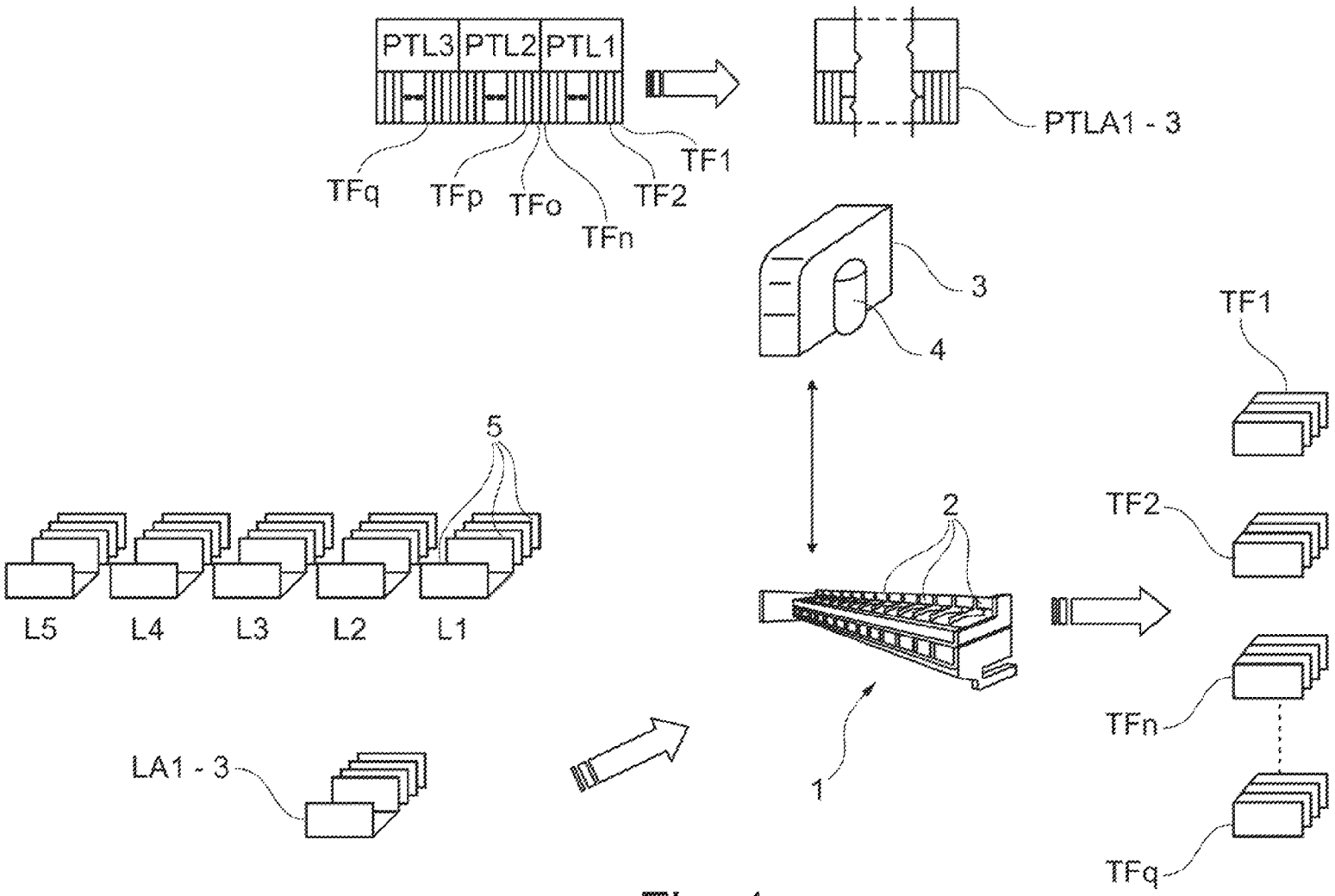
FIG. 1 is a diagram showing the principle of how batches of mailpieces are processed in accordance with the invention.

FIG. 1 shows a postal sorting machine 1 that is, in this example, part of an inward sorting center where the mailpieces are thus sorted into sequence depending on delivery points of delivery rounds. This inward sorting can require a plurality of sorting passes.

The sorting machine 1 has a set of sorting outlets 2, which, in this example, are accumulation sorting outlets with, for example, each outlet having a storage capacity of 150 letters on edge.

The postal sorting machine 1 is controlled by a control unit 3, e.g. a network of computers connected to a communications channel such as the Internet and to which network the above-indicated central server belongs. The control unit operates a memory 4 that stores the unique identifiers of the mailpieces to be sorted in the postal sorting machine 1 and the associated sort codes.

The mailpieces sorted by the outward sorting center arrive at the inward sorting center grouped together in distinct batches, each batch containing mailpieces distributed over a group of delivery rounds. Batches of mailpieces are thus prepared daily by the outward sorting center for each inward sorting center and are transported, e.g. in bins in a truck or the like, to each inward sorting center.

FIG. 1 shows five batches of mailpieces indicated by L1 to L5 coming from an outward sorting center and to be sorted in the postal sorting machine 1. Typically, several tens of batches of mailpieces can be received daily by an inward sorting center.

It is considered below that the batches of mailpieces L1 to L3 under-use the capacity of the postal sorting machine 1 in the meaning of the invention. The sorting plans PTL1 to PTL3 that correspond to the batches of mailpieces L1 to L3 and that are recorded in the memory 4 are shown symbolically. Each sorting plan PTL1 to PTL3 is actually an ordered list of delivery points of delivery rounds put into correspondence with sorting outlets of the postal sorting machine 1, each of said delivery points corresponding to a respective delivery postal address of a mailpiece.

FIG. 1 also shows that the sorting plan PTL1 corresponds to the inward sorting of the mailpieces for the delivery rounds identified by TF1, TF2, . . . TFn, while the sorting plan PLT2 corresponds to the inward sorting of the mailpieces for other delivery rounds indicated by TFo, TFp, . . . TFq. Typically a batch of mailpieces may correspond to about ten delivery rounds. Thus, stored in the database are static representations of all of the delivery rounds of the inward sorting center in the form of a list of delivery points for each delivery round, and also stored in the database are the lists of the mailpiece identifiers corresponding to respective ones of the various batches of mailpieces L1 to L5 with a sort code or delivery point corresponding to each identifier.

In the method of the invention, the batches of mailpieces L1 to L5 are assessed in the control unit 3 before the machine sorting to detect those that will under-use the sorting capacities of the machine, i.e. those for which the mailpieces will fill the sorting outlets of the postal sorting machine 1 to an insufficient extent.

The assessment is performed by means of knowledge of the delivery points associated with the mailpieces by the control unit 3 in the stored database 4. This information can be available as soon as the delivery postal address recognized by OCR on the mailpieces is determined in full. For simplification, it is assumed that this full determination is obtained in the outward sorting process that is upstream from the inward sorting process. But the delivery address may also be determined in full while the batches of mailpieces are being transferred physically from the outward sorting center to the inward sorting center.

Figure 2:
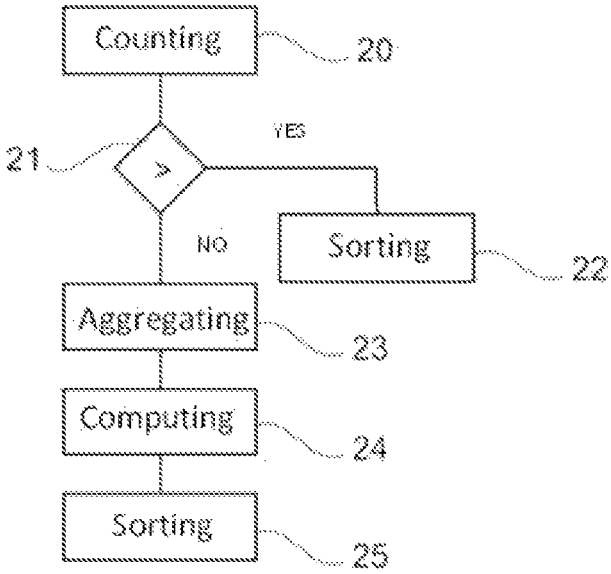
FIG. 2 is a flow chart showing the principle of how batches of mailpieces are aggregated in accordance with the invention.

With reference to FIG. 2, the assessment may consist in counting the number of mailpieces to be delivered for each delivery point of a delivery round, this counting taking place at 20 in the control unit 3 for each batch of mailpieces L1 to L5. It is then possible to detect the delivery points that are actually in the batches of mailpieces, of the mail to be delivered (active delivery points) and thus to compute, in the control unit 3 and for each batch of mailpieces, the cumulative value of the number of active delivery points for a batch of mailpieces serving as a value for measuring the machine occupancy level for that batch of mailpieces.

In the control unit 3, said cumulative value for each batch of mailpieces may be compared with a threshold in step 21. For example, with a postal sorting machine having twenty sorting outlets and for sorting in three sorting passes, the threshold may correspond to 6500 active delivery points.

If the cumulative value is greater than the threshold, the batch of mailpieces is considered as using the sorting capacities of the postal sorting machine 1 satisfactorily, and the batch of mailpieces, e.g. the batch L4 or the batch L5 is put into the postal sorting machine 1 and is sorted in step 22, by using the corresponding static sorting plan recorded in the memory 4.

If the cumulative value is less than the threshold in step 21, the process continues in step 23 with a stage consisting in aggregating the batches of mailpieces that are detected as under-using the sorting capacities of the postal sorting machine 1. In the example, the batches in question are the batches shown by L1 to L3. It is possible, on a daily basis in an inward sorting center, to detect several tens of batches of mailpieces under-using the machine capacity due to the fact that the volumes of mail vary every day. Aggregating the batches of mailpieces may consist in physically concatenating two or more batches of mailpieces in such a manner that the overall cumulative value of the active delivery points with the aggregated batches of mailpieces is close to but less than the threshold value. It is understood that this concatenation of a plurality of batches of mailpieces can require seeking the optimum combination of the batches of mailpieces to be concatenated together. This search for the optimum combination is made by the control unit 3, e.g. by simulation.

Figure 3:
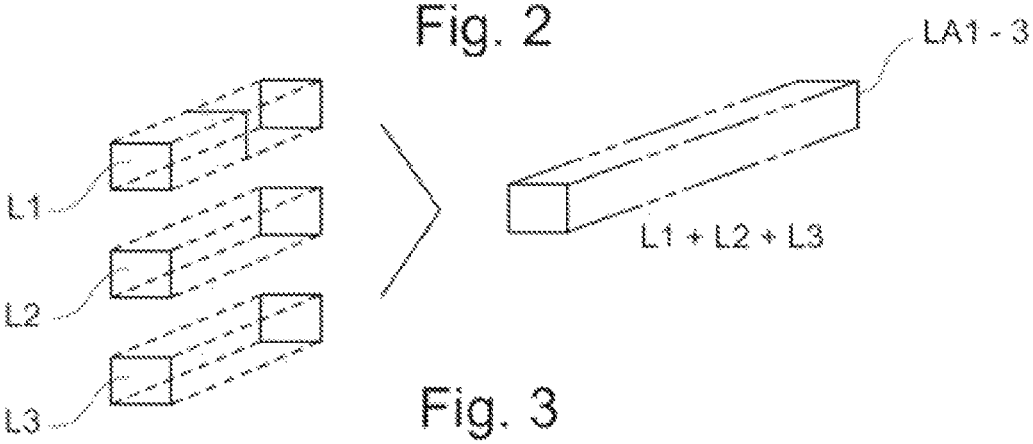
FIG. 3 shows concatenation of batches of mailpieces.

FIG. 3 shows the concatenation of the three batches of mailpieces L1 to L3 into a single aggregated batch of mailpieces LA1-3 which thus includes a number of active delivery points that is close to the above-indicated threshold.

Once the control unit 3 has determined the optimum combination for aggregating the mailpieces, in step 24 it dynamically re-computes the new sorting plans associated with respective ones of the aggregated batches of mailpieces. FIG. 1 shows, at PTLA1-3, the new sorting plan associated with the aggregated batch of mailpieces LA1-3. Computing the sorting plan PTLA1-3 thus re-associates only the active delivery points in the batches of mailpieces L1-L3 with the sorting outlets of the postal machine 1 and may also be arranged to optimize the filling of the sorting outlets while avoiding overflow from the sorting outlet receptacles.

Then, each aggregated batch of mailpieces such as LA1-3 is put into the postal sorting machine 1 (step 25) so as to be sorted by using the dynamically computed sorting plan such as PTLA1-3 and so as to supply sequences of mailpieces corresponding to delivery rounds TF1, TF2, TFn, TFq as shown in FIG. 1.

The method of the invention thus contributes to optimizing use of the sorting capacities of the postal sorting machine.

Figure 4:
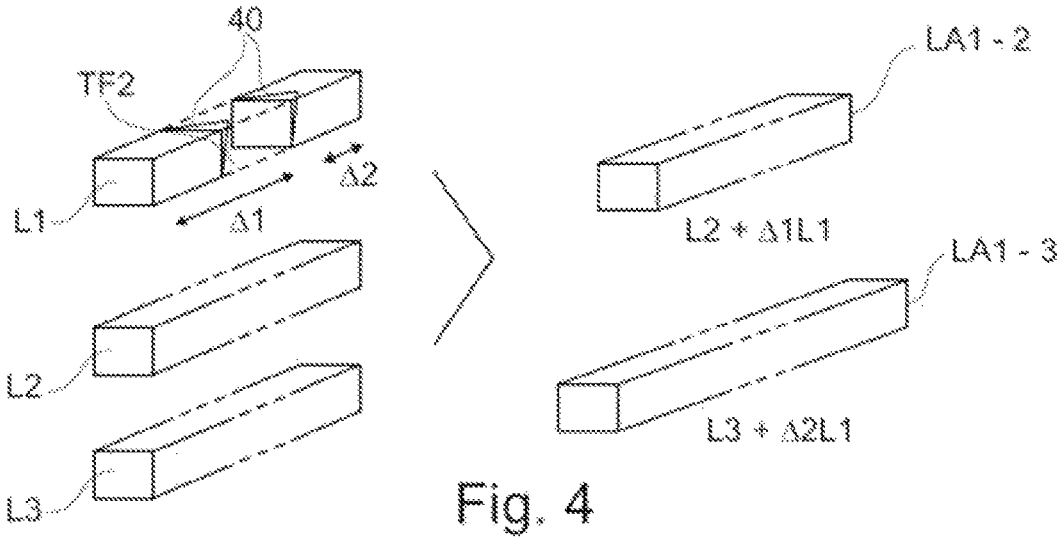
FIG. 4 shows redistribution of delivery rounds in the batches of mailpieces.

The aggregating of the invention in step 23 may be finer than merely concatenating batches of mailpieces. It may consist in dynamically distributing the delivery rounds in the aggregated batches of mailpieces. It is possible for the batches of mailpieces that arrive at the inward sorting center to be already segmented into delivery rounds by means of separators such as 40. In other words, for example, the mailpieces of the delivery round TF2 in the batch of mailpieces L1 are separated from the other mailpieces by two separators 40. Therefore, rather than an overall concatenation of batches of mailpieces, the control unit may seek an optimum combination by taking into account a cumulative total of active delivery points per delivery round within each batch of mailpieces detected as under-using the capacity, so as to achieve partial concatenation of the batches of mailpieces, which corresponds to redistributing the delivery rounds in the aggregated batches of mailpieces, as shown in FIG. 4. In FIG. 4, the aggregating has resulted in splitting the batch of mailpieces L1 into two segments Δ1 and Δ2 which have then been concatenated respectively with the batches L2 and L3 so as to form two aggregated batches of mailpieces LA1-2 and LA1-3.

Additionally, in order to take even further account of the fact that, in the batches of mailpieces, a large number of successive delivery points in a delivery round can be inactive, the aggregating may, in addition, consist in temporarily dynamically reassigning active delivery points in the delivery rounds within the aggregated batches of mailpieces so as to eliminate delivery routes on which no mail is actually delivered. The dynamic reassignment of the delivery points may be performed by means of tools for automatically routing delivery rounds through active delivery points.

Figure 6:
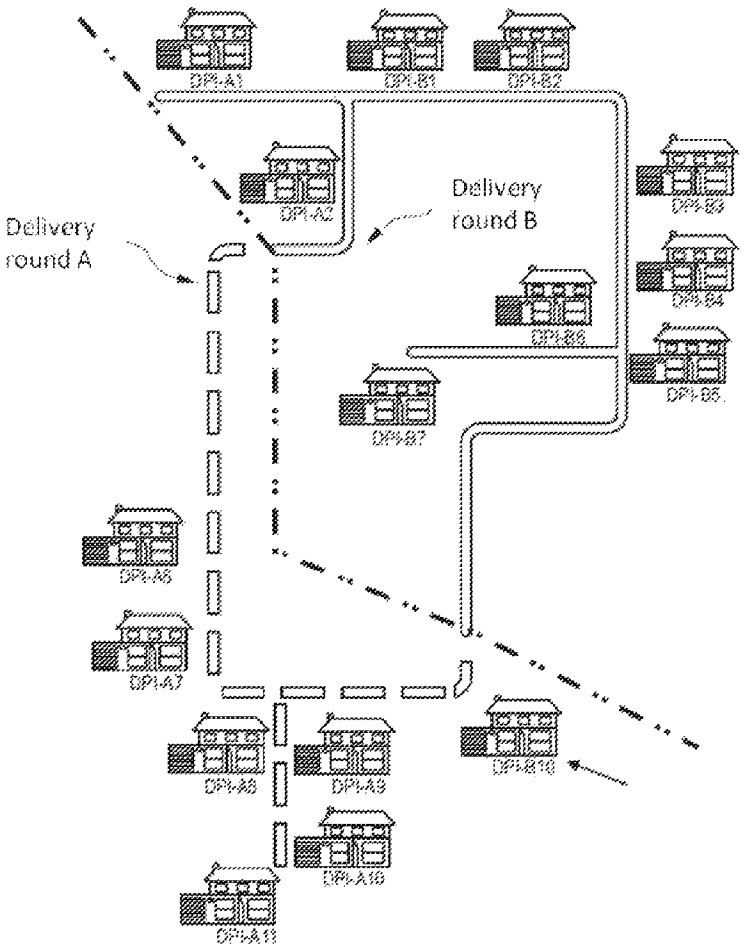
FIGS. 5 and 6 show geographical reassignment of the delivery points in the delivery rounds associated with the batches of mailpieces.
Figure 5:
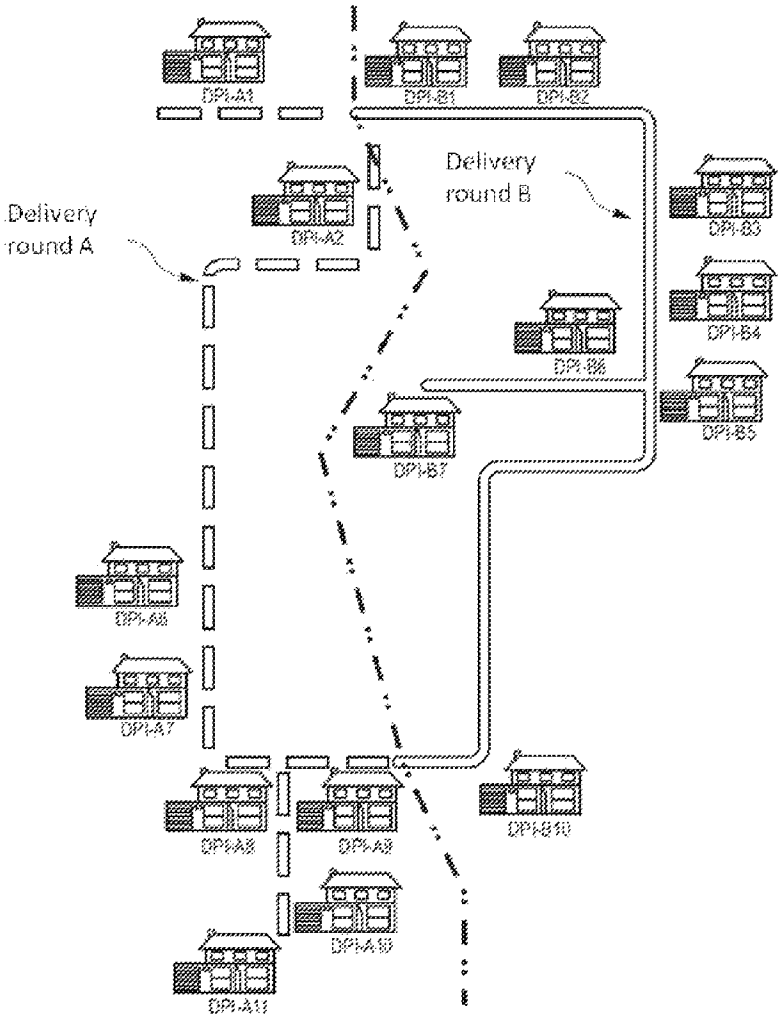

FIG. 5 shows two contiguous delivery rounds A and B with respective delivery points DPI-A1 to DPI A11 and DPI-B1 to DPI-B10. After the control unit 3 has detected that the delivery points DPI-A3 to DPI-A5 and DPI-B7 to DPI-B9 are not active (no mail to be delivered for these delivery points), the new sorting plan for an aggregated batch of mailpieces including these delivery rounds will take account of a temporary geographical reassignment of the delivery points between the two delivery rounds, as shown in FIG. 6.

This dynamic reassignment of the active delivery points in the delivery rounds makes it possible to achieve even finer aggregating of the batches of mailpieces and thus to improve optimization of use of the postal sorting machine with the aggregated batches of mailpieces.

When delivery points are reassigned, it is necessary to assist the delivery person in delivering the mail, e.g. by assigning geographical coordinates to each delivery point, it being possible for these coordinates to be loaded in mobile equipment that is provided with a space-based positioning system and with which the delivery person is equipped.

It is understood that the batches of mailpieces are aggregated physically by the operator of the postal sorting machine, who may be assisted by instructions displayed on a computer screen.

The invention may be extended to an application context with three sorting centers:

an outward sorting center where the sorting performed makes it possible to determine the inward sorting center to which the mail should be sent on the basis of its post code or "ZIP code".

an inward sorting center where the sorting performed makes it possible to separate the mail into batches in which delivery rounds are grouped together; and a delivery office that sorts the batches of mail into ordered delivery rounds, which delivery rounds are themselves separate from one another.

In this implementation of the method of the invention, the assessment of the batches of mail that is performed by the control unit has an impact not only on the sorting plans of the machines of the delivery office, but also on the sorting plans of the inward sorting center.

While the foregoing is directed to embodiments of the present invention, other and further embodiments of the invention may be devised without departing from the basic scope thereof, and the scope thereof is determined by the claims that follow.

The invention claimed is:

1. A method of processing mailpieces for sorting a plurality of batches of mailpieces into sequence in a postal sorting machine based on delivery points of delivery rounds, wherein the mailpieces are sorted in the postal sorting machine by batch as a function of various sorting plans associated respectively with the various batches of mailpieces, each sorting plan associated with a batch of mailpieces defining an ordered list of delivery points of one or more delivery rounds, said ordered list being saved in the memory of a control unit controlling the sorting machine, wherein the method comprises assessing batches of mailpieces in the control unit before machine sorting to detect those that will under-use the sorting capacities of the postal sorting machine, a batch of mailpieces under-uses the sorting capacities of the postal sorting machine when the batch of mailpieces will fill the sorting outlets of the postal sorting machine during a sorting pass to an insufficient extent, wherein if an under-use of the sorting capacities of the postal machine by a batch of mailpieces is detected, an optimized sorting plan optimizing the use of sorting capacities of the postal sorting machine is computed for said batch of mailpieces, said method further comprising the steps of:

computing in the control unit during the assessing of each batch of mailpieces a cumulative value of the number of active delivery points and comparing said cumulative value with a threshold value to detect the batches of mailpieces that will under-use the sorting capacities of the postal sorting machine;

aggregating the batches of mailpieces detected as under-using the machine by physically concatenating two or more batches of mailpieces that will under-use the capacities of the sorting machine so that the overall cumulative value of the active delivery points with the aggregated batches of mailpieces is close to but less than the threshold value;

computing in the postal sorting machine, for each aggregated batch of mailpieces, an associated optimized sorting plan resulting from the aggregating; and feeding each aggregated batch of mailpieces into the postal sorting machine and controlling the sorting machine to sort the mailpieces as a function of the optimized sorting plan computed for said aggregated batch of mailpieces.

2. A method according to claim 1, wherein the concatenation of two batches of mailpieces comprises a concatenation of segments of batches corresponding in a redistribution of the delivery rounds associated with the batches of mailpieces.

3. A method according to claim 2, further comprising reassigning active delivery points in the delivery rounds within the aggregated batches of mailpieces to eliminate delivery routes on which no mail is actually delivered.

4. A method according to claim 1, further comprising reassigning the active delivery points in the delivery rounds within the aggregated batches of mailpieces to eliminate delivery routes on which no mail is actually delivered.

* * * * *